United States Patent [19]

Golebieski

[11] 4,392,647

[45] Jul. 12, 1983

[54] FLOOR HOCKEY CAROM CORNER

[76] Inventor: William J. Golebieski, 300 Stoneybrooke Dr., Cheswick, Pa. 15024

[21] Appl. No.: 340,867

[22] Filed: Jan. 20, 1982

[51] Int. Cl.[3] ..... A63B 71/02

[52] U.S. Cl. ..... 272/3; 273/1 B; 273/118 R; 273/126 R; 273/411

[58] Field of Search ..... 272/3; 273/4 R, 51, 273/118 R, 126 R, 411, 1

[56] References Cited

U.S. PATENT DOCUMENTS

| | | | |
|---|---|---|---|
| 558,157 | 4/1896 | Chapman et al. | 273/126 R |
| 2,809,040 | 10/1957 | Trovato | 273/4 R X |
| 3,762,711 | 10/1973 | Cooper | 273/126 R |
| 4,063,728 | 12/1977 | Zemanek | 273/4 R |
| 4,330,122 | 5/1982 | Sheinberg et al. | 273/51 |

FOREIGN PATENT DOCUMENTS

| | | | |
|---|---|---|---|
| 706283 | 3/1965 | Canada | 273/411 |
| 950905 | 2/1964 | United Kingdom | 273/118 R |

*Primary Examiner*—Anton O. Oechsle
*Attorney, Agent, or Firm*—Thomas H. Murray

[57] ABSTRACT

A floor-hockey carom corner comprises a pair of hinged members, which are adapted to form a 90-degree corner while supported against a floor surface in a cushioned, nonskid manner; inside portions of the hinged members remote from the hinge having arcuately hollowed portions, through which a member of a flexible sheet material, suitably bent or curved, is affixed to the hinged members to complete the structure. Advantages in terms of more realistic action, greater safety, eliminating unnecessary delays, and greater player satisfaction, are obtained.

6 Claims, 2 Drawing Figures

FLOOR HOCKEY CAROM CORNER

BACKGROUND OF THE INVENTION

1. Field of the Invention

This invention relates to sports equipment, and in particular, to a device for use in playing floor hockey or a similar indoor sport.

2. Description of the Prior Art

Various previous patents show attachments which can be placed in a corner so as to present a rounded surface at the juncture of wall sections, including U.S. Pat. Nos. 511,197; 2,651,086; 2,823,432; 3,950,907; 4,052,830; and 4,150,517. The aforementioned patents do not relate to sports such as floor hockey or indoor soccer, and they give no indication of the various advantages which can be obtained with a the use of a device according to the present invention.

In accordance with the prior art, the game of floor hockey is played in gymnasiums, multi-purpose rooms, and recreation areas without the use of any corner devices of the kind provided in accordance with the present invention. This leads to various disadvantages or difficulties. Without the use of corners, such as those provided in accordance with the present invention, the puck or ball more frequently enters passageways, corridors, locker rooms, and various other open spaces; this interferes with the continuity of the action and diminishes the satisfaction of the players.

The sport of floor hockey is frequently played by physical-education students at the elementary, intermediate, and secondary-school levels, and one of the principal reasons for learning and engaging in the sport of hockey is to improve hockey skills. In playing floor hockey without the use of corners of the kind provided with the present invention, there is the distinct drawback or disadvantage that the play does not realistically simulate the playing of ice hockey, a sport in which a playing area with suitably rounded corners is customarily provided and used, albeit at a level of expense for rink construction and maintenance far greater than that required for floor hockey. Thus, one drawback is that floor hockey played without corner members is unrealistic; another is that when rounded corners are not provided, the play is less safe, since the corner member prevents the puck or ball from skidding or rolling into a corner or passageway with two, three or more students in pursuit and in danger of collision and/or injury.

SUMMARY OF THE INVENTION

A floor-hockey carom corner comprises a pair of hinged members, which are adapted to form a 90-degree corner while supported against a floor surface in a cushioned, nonskid manner; inside portions of the hinged members remote from the hinge have arcuately hollowed portions, through which a member of a flexible sheet material, suitably bent or curved, is affixed to the hinged members to complete the structure. Advantages in terms of more realistic action, greater safety, eliminating unnecessary delays, and greater player satisfaction, are obtained.

DESCRIPTION OF THE DRAWINGS

A complete understanding of the present invention may be obtained from the foregoing and following description thereof taken together with the appended drawings, in which.

DESCRIPTION OF THE PREFERRED EMBODIMENTS

There will be described below in detail how a carom corner, according to the present invention, may be made and used.

Figure 1:
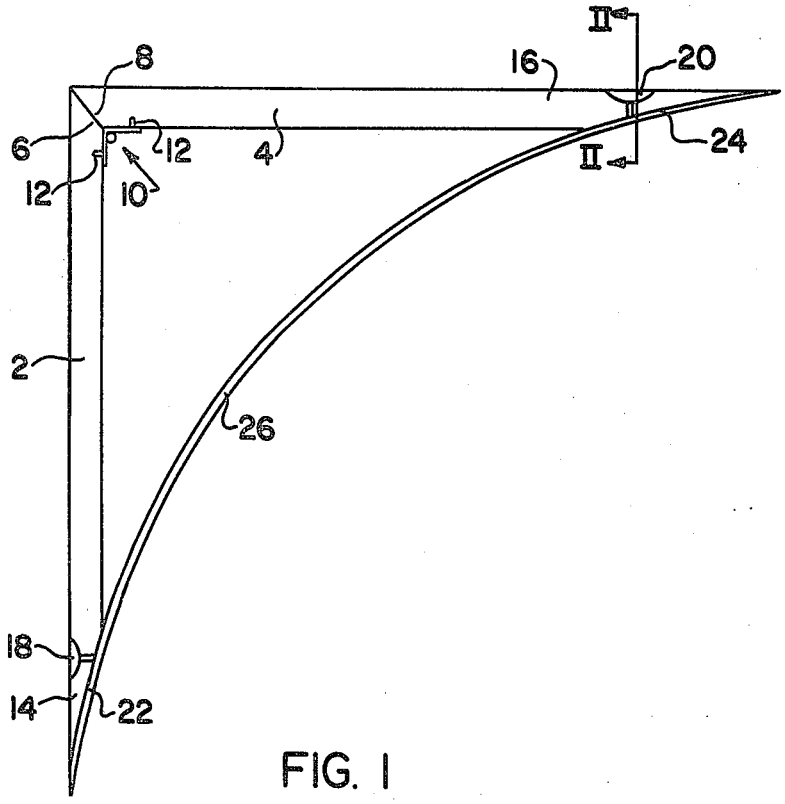
FIG. 1 is a plan view (not to scale) of a carom corner in accordance with the present invention.
Figure 2:
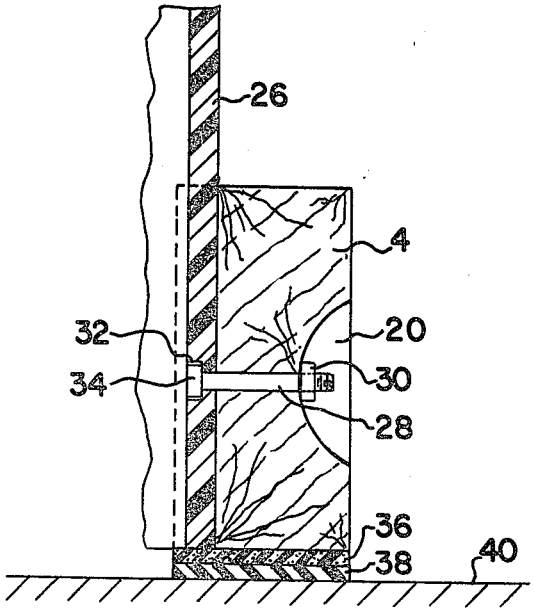
FIG. 2 is a detailed sectional elevation view taken on the line II—II in FIG. 1.

First, there are made two members, 2 and 4, which have chamfered ends 6 and 8, respectively, whereat they are joined by a hinge 10 by means of screws 12 to form a 90-degree joint. The ends 14 and 16 of the members 2 and 4, respectively, are provided with countersunk portions 18 and 20, respectively, for a purpose hereinafter to be explained. Moreover, the inside portions of the ends 14 and 16 are made to have an arcuate shape, as at 22 and 24, respectively, in order that there may be conformingly supported against them a piece 26 of flexible sheeting material, such as polyethylene. If desired, and especially if the carom corner is relatively large, there may optionally be provided centrally on the back side of the flexible-shield piece 26 a V bracket (not shown). As best seen in FIG. 2, the piece 26 has a height several inches greater than of the piece 4, to which it is secured by a bolt 28 and cooperating nut 30, which fits within the recess 20. Nuts 30 may be in the form of hexagonal nuts or wing nuts. The piece 26 preferably contains a recess 32, which is of such size and shape as to receive snugly the head 34 of the bolt 28. Also, as seen in FIG. 2, the underside of the piece 4, and also correspondingly the piece 2, is provided with layers 36 and 38 of rubber or other suitable materials, in order that the article may be supported against the floor 40 in a cushioned, non-skid manner. Preferably, for the layer 36, there is used a thin underlayer of sponge rubber, which is molded or otherwise suitably secured to the bottom of the frame member 4, and then cushioned by a thin layer 38 of red rubber of good quality having a pebble-grain which serves to minimize sliding movement and to stabilize the carom corner when it is in use.

Although the exact dimensions of various parts mentioned above may be varied, as those skilled in the art will readily appreciate, in order to suit the requirements of this particular case, in general, the frame members are about 3 inches wide by 5 inches high, with a length on the order of 4 to 6 feet, and the panel 26 has a height of about 8 or 10 inches, a thickness of about $\frac{3}{8}$ inch or $\frac{1}{2}$ inch, and an appropriate length, i.e., approximately 1.57 times the length of one of the frame members 2 or 4.

A carom corner for floor hockey or the like which has been constructed as indicated above may be readily assembled when needed. It may also readily be dismantled for storage when not in use. Moreover, such an article also affords means of overcoming the various drawbacks or disadvantages detailed above.

Although the invention has been shown and described in connection with a certain specific embodiment, it will be readily apparent to those skilled in the art that various changes in form and arrangement of parts may be made to suit requirements without departing from the spirit and scope of the invention.

I claim:

1. A carom corner for an indoor floor game, said corner comprising, in combination first and second frame members, each of said frame members having a chamfered end whereby said frame members may be joined to form a right angle, hinge means joining said frame members, said frame members further having in the vicinity of their ends remote from said hinge arcuately shaped recessed portions, a panel member of flexible material and arcuate shape, and means securing the ends of said panel to said remote ends of said frame members.

2. A carom corner as defined in claim 1, said corner comprising means for supporting said panel against a floor in a cushioned, non-skid manner.

3. A carom corner as defined in claim 2, wherein said means for supporting said panel against a floor in a cushioned non-skid manner comprises against said frame member a first layer of sponge rubber and against said floor a second layer of red pebble-grain rubber.

4. A carom corner as defined in claim 1, wherein said means securing said panel to said frame members comprises (a) a pair of flat-headed bolts snugly received within recesses in said panel and (b) a pair of nuts cooperating with said flat-headed bolts.

5. A carom corner as defined in claim 4, wherein the nuts of said pair of nuts are hexagonal nuts.

6. A carom corner as defined in claim 4, wherein the nuts of said pair of nuts are wing nuts.

* * * * *